United States Patent [19]

Butera et al.

[11] Patent Number: 4,530,612

[45] Date of Patent: Jul. 23, 1985

[54] METHOD FOR ADAPTIVELY USING A PRINT RIBBON IN AN IMPACT PRINTER

[75] Inventors: William J. Butera, Korntal, Fed. Rep. of Germany; Peter Stucki, Langnau am Albis, Switzerland

[73] Assignee: International Business Machines Corp., Armonk, N.Y.

[21] Appl. No.: 520,799

[22] Filed: Aug. 5, 1983

[51] Int. Cl.[3] ..... B41J 33/36; B41J 33/56

[52] U.S. Cl. ..... 400/232; 400/197; 400/225; 400/240.4; 400/249

[58] Field of Search ..... 400/197–202.4, 400/223, 225, 232, 233, 249, 218, 219, 224, 224.1, 224.2, 239, 240, 240.3, 240.4, 244

[56] References Cited

U.S. PATENT DOCUMENTS

| | | | |
|---|---|---|---|
| 2,569,145 | 9/1951 | Berger | 400/223 |
| 4,037,708 | 7/1977 | Walker-Arnott | 400/240.3 |
| 4,128,348 | 12/1978 | Steele et al. | 400/198 |
| 4,132,486 | 1/1979 | Kwan | 400/225 |
| 4,297,043 | 10/1981 | Dargatz | 400/225 |

FOREIGN PATENT DOCUMENTS

| | | | |
|---|---|---|---|
| 40312 | 11/1981 | European Pat. Off. | 400/54 |
| 57-2790 | 1/1982 | Japan | 400/249 |
| 57-15991 | 1/1982 | Japan | 400/249 |
| 57-103880 | 6/1982 | Japan | 400/249 |
| 474757 | 8/1969 | Switzerland | 356/212 |
| 775645 | 5/1957 | United Kingdom | 400/249 |

OTHER PUBLICATIONS

*IBM Technical Disclosure Bulletin*; vol. 23, No. 8; Sweet et al.; "Reduced Consumption of Ribbon in an Impact Printer"; p. 3506; Jan. 1981.

*IBM Technical Disclosure Bulletin*; vol. 22, No. 7; Baker et al.; "Multicolor Printing"; p. 2633–2635; Dec. 1979.

"An Easy Guide for Operating the Remington Portable Typewriter"; Anonymous; 1925.

*Primary Examiner*—Paul T. Sewell
*Assistant Examiner*—David A. Wiecking
*Attorney, Agent, or Firm*—Richard E. Bee

[57] ABSTRACT

Rather than repeatedly using the entire length of a multi-color print ribbon in an impact printer until the reaching of a lower quality threshold requires replacement of the ribbon, this invention causes only a subsection of limited length of the ribbon to be used until the lower quality threshold of any one of the color tracks of this subsection is reached, after which the ribbon is advanced to enable use of a fresh subsection.

The quality status of the currently used subsection may be monitored by counting the number of impacts on each individual color track and comparing that number with a predetermined, stored value, or by shining light through the ribbon and optically comparing the passing light with a preset value. The method is flexible enough to permit manual advance of the ribbon to a fresh subsection in case a printing job requires highest possible quality.

12 Claims, 10 Drawing Figures

FIG. 1
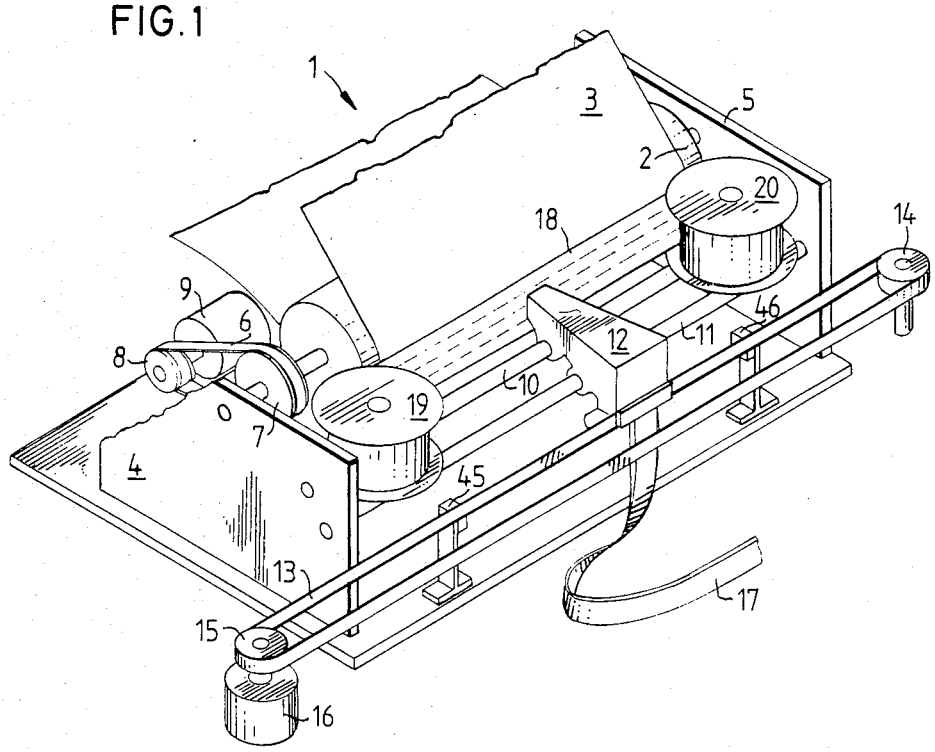
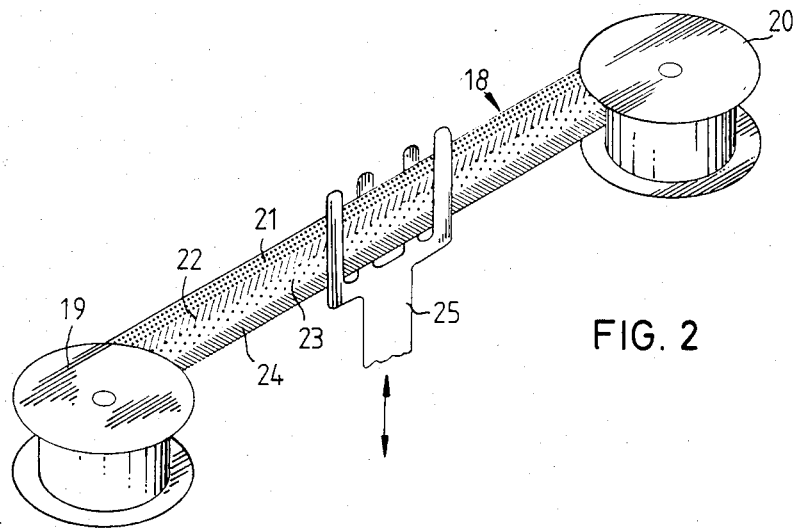
FIG. 2

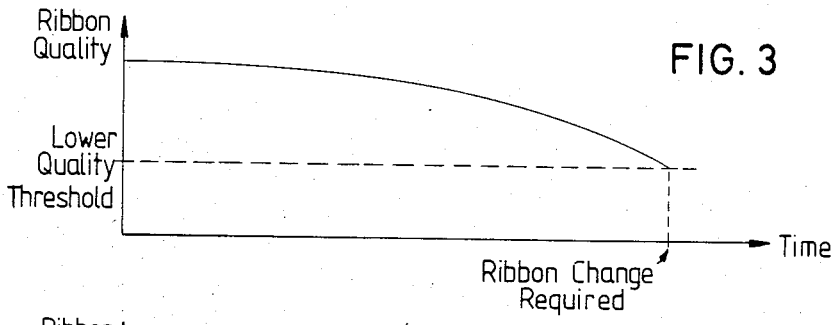
FIG. 3
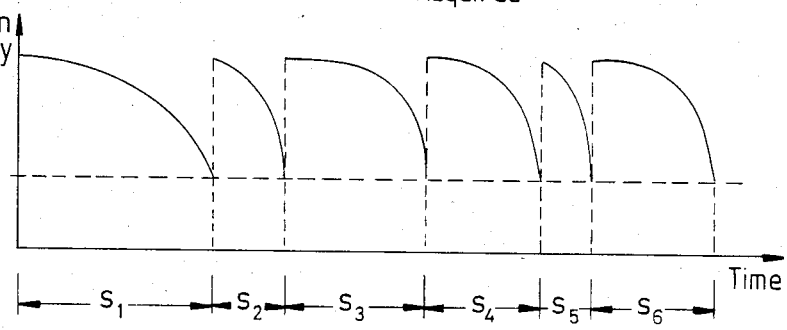
FIG. 4
FIG. 5
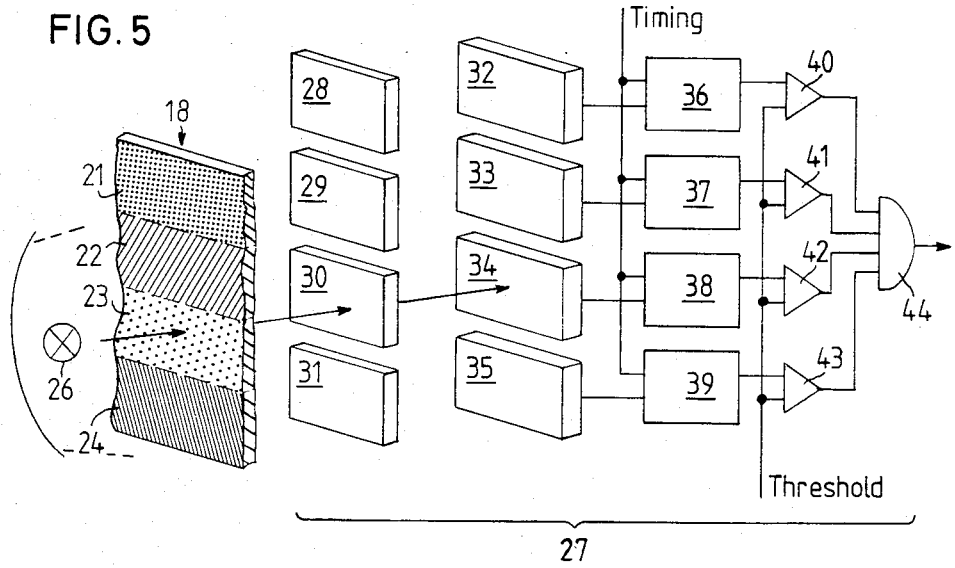

METHOD FOR ADAPTIVELY USING A PRINT RIBBON IN AN IMPACT PRINTER

DESCRIPTION

1. Technical Field

The invention relates to a method for adaptively using a print ribbon in an impact printer such as a typewriter or dot matrix printer, for example.

2. Background Art

Generally, in impact printers, two types of print ribbon are used. The first may be called a single-use ribbon, where the coloring material, such as carbon, at the impact location is completely transferred to the record carrier, thus leaving a non-coloring area on the ribbon substrate, so that after one complete pass of its entire length for successive printing the ribbon has to be discarded, save any provisions for repleting. The second type of ribbon, in contrast, may usually be passed back and forth several times in front of the printing station since after each impact and ensuing removal of dye from the impact location, sufficient time is provided as the ribbon is further advanced, and later reversed, for the dyestuff to "bleed" into depleted areas from the neighborhood so as to maintain a reasonable though continuously degrading print quality over several reversals of the transport direction of the ribbon. These print ribbons as well as their transport mechanisms are so commonplace that it appears unnecessary to list references for their description.

As was pointed out before, with the second type of ribbon, one has to accept that the print quality gradually decreases until it reaches a minimum tolerance level at which the ribbon has to be replaced. This is very simple in the case of a single-color ribbon but complex if a multi-color ribbon is employed because not all of the colors will be used with the same frequency. It may happen, therefore, that red, for example, was frequently used for printing pictures and is accordingly rather depleted after some time, while yellow was rarely used and thus stays fresh.

Another point to consider is the smudging of the ribbon through take-up thereby of dust and dirt which may cause ribbon areas unwilling to print although enough colorant is available, or which leads to undesirable obscuring or changing of colors.

Swiss Pat. No. 474 757, which corresponds to U.S. Pat. No. 3,535,046, describes a method and device for measuring the density of the printing ink in a multicolor printer. A current sample of the printing ink of each color is compared with a standard of the respective color in that light is shone through the inks under investigation and directed onto photosensitive means for electronic comparison. That same Swiss Pat. No. 474 757 refers to conventional apparatus for determining the density of printing colors employing complementary color filters.

SUMMARY OF INVENTION

This state of the art does not address the economics of print ribbon use, in particular no provisions have been proposed to permit an appropriately fresh portion of the print ribbon to be made available at the printing station in case a high-quality printing job is to be performed. The present invention aims at proposing a method for adaptively using the print ribbon, i.e. provide undepleted ribbon if high quality printing is desired but leave the ribbon just as it happens to be if no special quality requirements have been signalled.

The method in accordance with the present invention for adaptively using a print ribbon, be it in single-color or multi-color impact printers, is characterized by transporting in forward and reverse directions, during printing operation, one section of predetermined length of the ribbon, continuously monitoring the condition of the printing color or colors in said one section until the condition of said color or of any one of the colors in said one section has reached a predetermined lower tolerance level, then advancing the ribbon so as now to expose at the printing station the subsequent, fresh section of the ribbon, regardless of the condition of the possibly remaining colors in said one section, and repeating the procedure until the entire ribbon is used up.

With this method, it will be possible to immediately advance to a fresh ribbon section through manual intervention by the operator in case a printing job is signalled to require high quality printing.

BRIEF DESCRIPTION OF THE DRAWINGS

Details of the method in accordance with this invention will now be described with reference to the attached drawings in which:

FIG. 1 shows the essential components of a wire matrix printer;

FIG. 2 shows a multi-color ribbon with its spools and lift fork;

FIGS. 3 and 4 depict the degradation of the ribbon quality over time;

FIG. 5 schematically shows an optical ribbon quality monitoring device;

DESCRIPTION OF THE PREFERRED EMBODIMENTS

Figure 6:
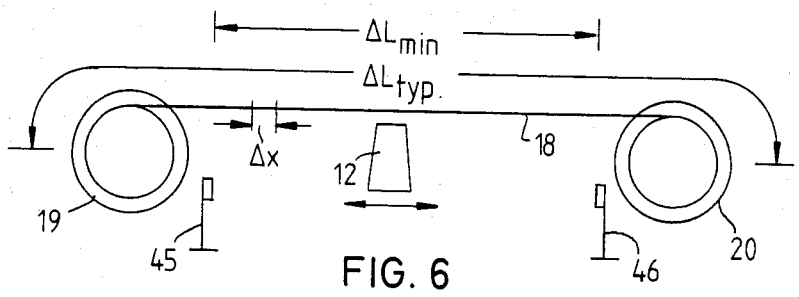
FIG. 6 refers to minimum and typical lengths of ribbon subsections.

Besides typewriters which account for the greater part of all impact printers in use today, there is an increasing number of dot-matrix impact printers which serve as output printers for digital computers, in particular in applications where alphanumeric characters and pictures are to be printed. In most previous cases, impact printers have used single-color ribbons but as the art of color image reproduction advances, the multicolor dot-matrix impact printer is gaining importance for producing sharp, accurate color images for graphics applications. .

While the method of the present invention is considered applicable to both single-color and multi-color impact printers, the explanation of the invention will be made by way of example with reference to a multi-color dot-matrix printer, the functioning of which will now briefly be reviewed.

Referring to FIG. 1, the printer 1 comprises a platen 2 which carries a record carrier such as a sheet of paper 3. Platen 2 is supported in frames 4, 5 and indexed via belt 6 and pulleys 7 and 8 by a stepper motor 9. Slidingly supported on rods 10 and 11 is a print head 12 which may be moved along the print line by a belt 13 slung around drums 14 and 15 and driven by a stepper motor 16.

Print head 12 contains, e.g. seven wires (not shown) spaced at equal mutual distances in a column, the tips of the wires being directed against platen 2 and their other ends coupled to electromagnets which may be selectively energized via a flexible cable 17 connected to appropriate control apparatus as is known to those skilled in the art. Printing of alphanumeric characters and symbols is through composition of single dots in a $7\times5$ matrix arrangement, i.e. after the parallel energizing of the appropriate. number of wires the print head has to be advanced by one fifth or less of a character width whereupon the selective energization for the then actual print position will be made, and so forth, until a character is completed and an intercharacter space is provided.

The wires impact actually against a print ribbon 18 arranged between platen 2 and print head 12 and extending between two spools 19 and 20. The latter are supported by means (not shown) for causing movement of the ribbon in both directions under control from a control unit to be described below. Print ribbon 18 (FIG. 2) has four parallel color bands 21 through 24, for example, with yellow (21), magenta (22), cyan (23) and black (24) inks, respectively. These inks permit printing in a total of seven different colors by superposition in accordance with the subtractive primary color system which is, for example, explained in European Patent Application No. 0.011 722. Print ribbon 18 may alternatively be dedicated to a different system of colors such as the one disclosed in Swiss Pat. No. 610.825 (U.S. Pat. No. 4,062,688) which prefers golden yellow, carmine, violet and turquoise. Still another system might comprise the positive primary colors red, yellow, blue and black, the black always being used to enhance contrast.

The color band to be presented at the print station for printing is selected by a print control unit which either controls the lifting of a conventional ribbon fork 25 or of said ribbon spools 19 and 20. The differently colored inks are composed such that every two inks impregnated on adjacent bands are mutually repelling so that their mixing (bleeding) is prevented and no degradation of one ink by its neighbor can occur.

Printers of the type described above presently can perform up to a speed of 5000 imprints per second. The limitation in speed is mainly dictated by the mechanical parts which must be moved, viz. the print wires and their associated electromagnets. With a further reduction of mass of the wire/electromagnet assemblies and with improvements in the materials used in the print head, still higher speed will certainly be possible soon.

Attainable printing speed and recent advances in LSI technology bring the introduction of image processing systems on the basis of dot-matrix impact printers closer to reality. However, the high density of multi-colored dots necessary for accurate image printing accents the need for precise, clear, clean dots from a print head/ribbon assembly. As a ribbon begins to age, it commences to produce faded, blurred dots which make an exact image reproduction impossible.

In the printers of the prior art, the entire ribbon is treated as one unit assumed to have the uniform deterioration characteristics as shown in FIG. 3. When the ribbon is new, its quality is, of course, very high, but with use the quality decreases until a lower quality threshold is reached at which replacement of the ribbon is required. Uniformity of wearing is achieved by advancing the ribbon by a small increment after each printing impact until the entire supply of new ribbon is used up and then reversing the direction of transportation several times until said lower quality threshold is reached.

There are several problems with this method which make it unsuitable for high-resolution color printing. The primary problem is that multi-color ribbons cannot be made to wear uniformly across all colors. Invariably, part of the ribbon will become smudged or faded, or one of the lighter colors collects dust or dirt. Accordingly, one or more of the color bands may have reached their predetermined lower quality level while others have not, yet the ribbon continues to be used since part of it is still usable. Obviously, images printed with a ribbon in this state will have blurred, faded or otherwise corrupted sections.

Another problem with prior art printers is that there is no reliable method for monitoring ribbon quality. The surest sign that a ribbon needs replacing is a poor color print. And it is indeed difficult to set a lower quality threshold since printing jobs may have different quality requirements. If a job requires high quality, with prior art printers the operator is forced to replace the ribbon although it may not yet be worn down.

The method of the present invention remedies these problems by partitioning the entire ribbon into several sections of essentially equal length and employing those sections for printing sequentially until each one reaches its individual lower quality level and then switching to a fresh section. FIG. 4 shows this for a color ribbon partitioned into six sections $S_1 \ldots S_6$, with the life of the sections varying with the parameters of the color images printed, such as frequency of color changes, color dot density, printer speed, degree of resolution, etc. The comparatively fast deterioration of subsections $S_2$ and $S_5$ may be due to dark color overprint causing a lighter color band to fade or a high frequency of color variation causing streaks on the ribbon's color bands. Because in accordance with this method one section is completely exhausted before the printer switches to the next, the faster deterioration of sections $S_2$ and $S_5$ in the example of FIG. 4 is not allowed to harm the overall picture quality.

To advantageously employ the inventive method, it will be necessary to continuously monitor the quality of the ribbon section currently in use. The following three schemes are contemplated to do this:

The first monitoring scheme employs discrete counters to count the number of times the individual color bands in a ribbon section are struck by the wires of the print head to produce a dot. Each color is assigned its own empirically determined maximum count. When the number of dots produced from a particular color exceeds the maximum count for that color, the monitor will issue a signal causing the ribbon transport mechanism to advance the ribbon to its next section. In presetting the maximum number of counts, the quality requirements of the printing job can be balanced against ribbon longevity.

The second monitoring scheme as shown in FIG. 5 is basically optical and comprises a light source 26 and a photodetector 27. The idea here is that a streaked, smudged or faded ribbon can be detected by the intensity of light it emits. The photodetector is mounted adjacent print head 12, and as the latter is advanced the detector scans ribbon 18. Light from source 26 passes through a short length of each color band of ribbon 18 to a bank of optical filters 28 through 31. Each filter suppresses every color except the one of the color band directly in front of it. For example, light shone through the magenta band 22 is passed through corresponding filter 29. The filtered light is then passed to a string of photosensitive elements 32 through 35 which convert the intensity of the color received from their associated filter 28 through 31 to electrical signals which they feed to individually connected integrators 36 through 39. Each integrator adds the signals received over time to the previous output of the respective photo-sensitive element 32 through 35 and supplies its output signal to one of comparators 40 through 43 which have one of their inputs commonly connected to a threshold voltage. Separate adjustment facilities may be provided at the comparators so as to permit the threshold for each color to be preset individually.

If after a specified time, which may e.g. correspond to one sweep, the voltage output from one integrator is below the threshold for the color concerned, then detector 27 signals via OR gate 44 that one of the color bands in the current subsection is corrupted. Ribbon 18 is then advanced to the next, fresh section.

The third scheme simply involves a manual advance option. When, for any reason, the operator desires to proceed to a fresh section of ribbon 18 e.g. for a printing job requiring high quality, this option may be used. The ribbon then advances to the next section regardless of the state of the current section.

The length of the ribbon sections can be set by the operator prior to printing. The minimum practicable length corresponds to the distance the print head 12 can travel across platen 2 between the left and right stops 45, 46 (FIGS. 1 and 6). Typically, the length $\Delta L$ of a section should extend on both sides beyond said travel distance. In the latter case, to ensure uniform aging-/wearing of the entire section, ribbon 18 should be advanced to a new subsection by a tiny fraction $\Delta x$ of the section length $\Delta L$ for every couple of print head carrier returns.

Figure 7:
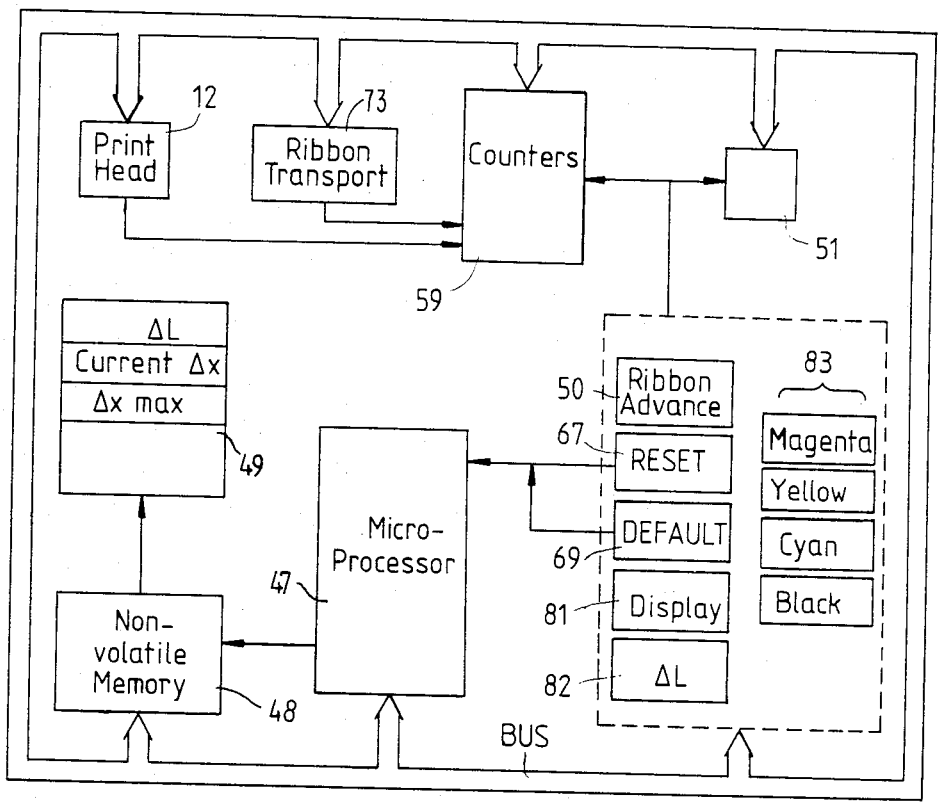
FIG. 7 represents the interconnections between the components of a ribbon quality monitor.

Implementation of the method so far described is best done on a microprocessor-based system having the necessary degree of functionality. A block diagram for such a system is shown in FIG. 7. For the purpose of the following description, the operation of the system is divided into three phases: power-up, normal operation, and power-down.

During the power-up cycle, microprocessor 47 runs through some checkout routines and then reads the operating parameters pertaining to the previous operation out of a non-volatile memory 48 and into the appropriate units, such as a random access memory 49. Into specific areas of memory 49 are read the maximum count for the wire impacts on the ribbon for each color band 22 . . . 25, the length $\Delta L$ for the ribbon sections, the current count for $\Delta x$, and the maximum count for $\Delta x$. The previous values of the counters (which were saved in memory 48) are rounded off and read back into the counters. When this is complete, microprocessor 47 commences normal operation by causing the printer to print.

Figure 8:
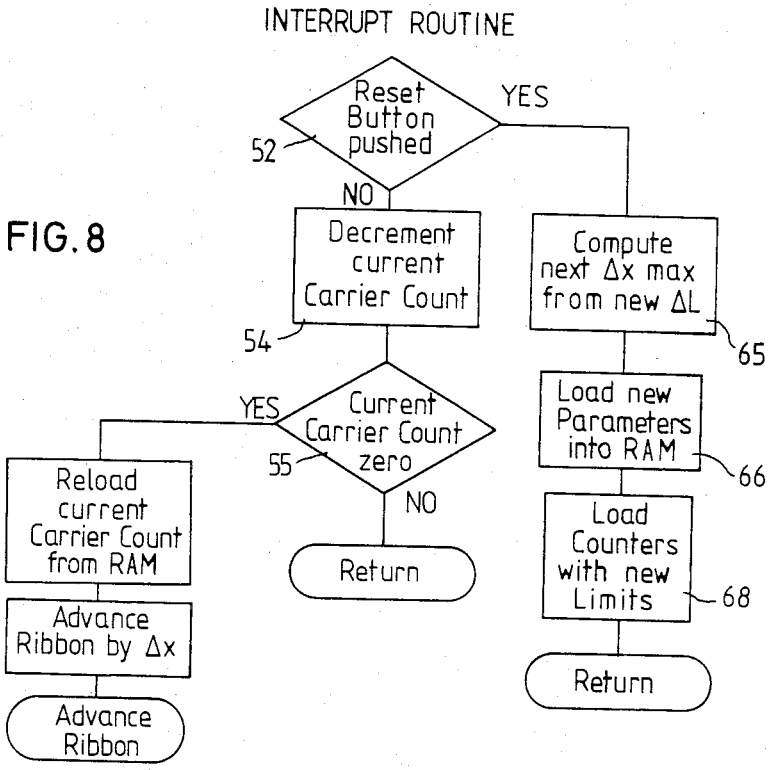
FIGS. 8 and 9 show flow diagrams for the interrupt and ribbon advance routines, respectively.
Figure 9:
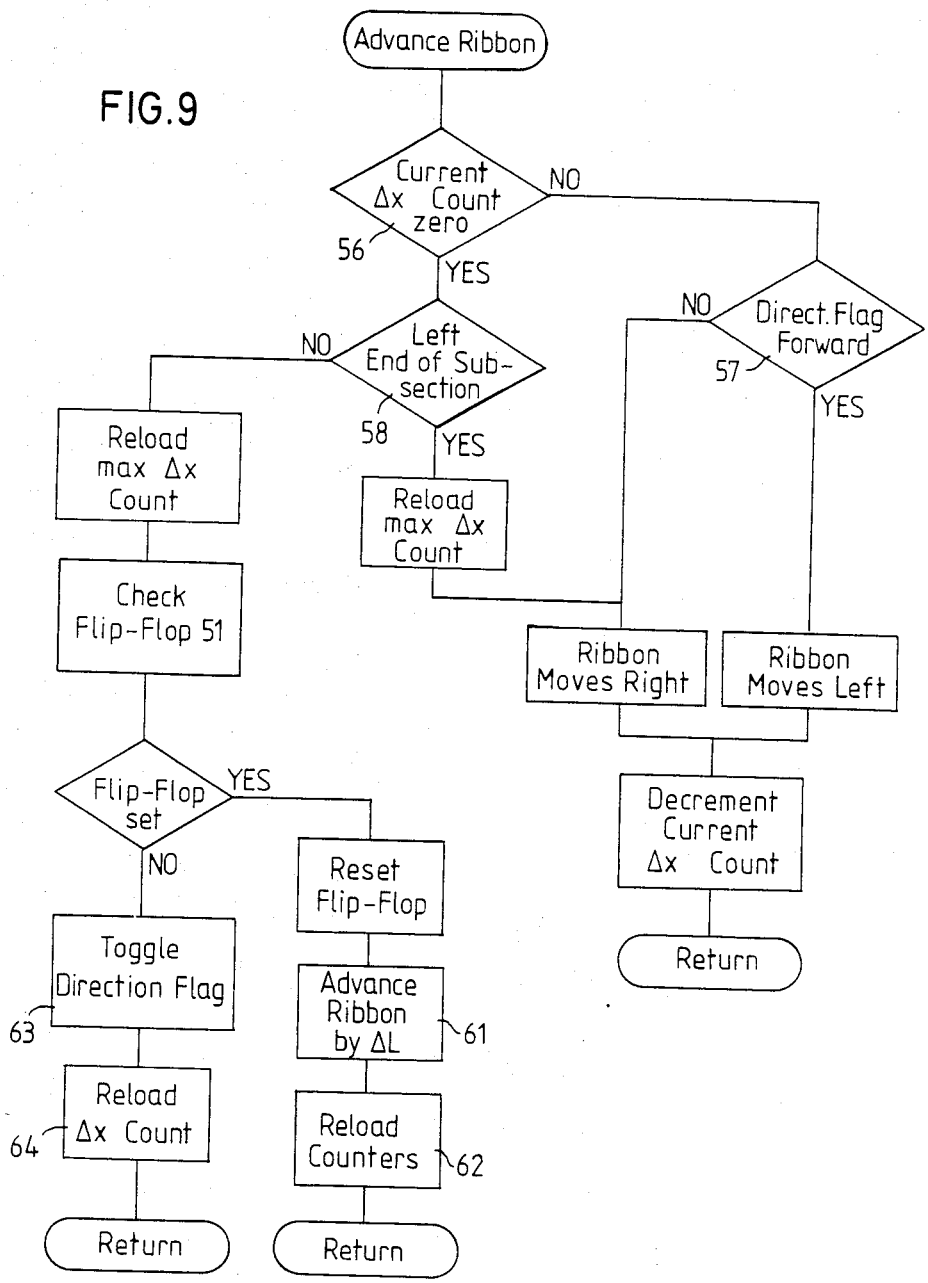

During printing operation, the number of impacts the print wires perform on ribbon 18 is counted separately for each color. Simultaneously, the photodetector 27 is swept across ribbon 18 to discover any faded or smeared color bands. When the impact count for any color exceeds the preset value or a corrupted color band is found, or if the manual ribbon advance button 50, FIG. 7, is pushed, a flip-flop 51 is set to be read later by processor 47. When a return of the print head carrier is signalled by printer 1, an interrupt signal is generated, and microprocessor 47 enters an interrupt routine (FIG. 8). In block 52, first the RESET button 67 is checked. Since the mechanism is preferably designed such that hitting RESET button 67 does not have any effect while printing is in progress, flip-flop 51 is assumed to be reset. Therefore, the operation proceeds to block 54 decrementing the current carrier count which is representative of the number of carrier returns performed since the last time the ribbon was advanced. When the current carrier count reaches zero (block 55), said count is reloaded from memory 48 and the ribbon is advanced by $\Delta x$ (FIG. 9) to a new subsection.

When microprocessor 47 determines that ribbon 18 should be advanced, it checks first on the direction of advancement, i.e. forward, backward or not at all, as would be the case if the length $\Delta L$ of a ribbon section was chosen to be equal to the distance of carrier travel. The processor will look at the number of times the ribbon was previously advanced by $\Delta x$ by asking whether the current $\Delta x$ count has reached zero (block 56 of FIG. 9). If the answer is NO, i.e. the ribbon has not reached the subsection at the end of the current section, the processor reads the direction flag stored in memory 48 (block 57). If the answer to the question of block 56 is YES, the processor asks the direction flag at which end of the section the ribbon is. If the ribbon is at the left end of the section (block 58), it just reverses direction and begins to progress to the right end of the section. If the ribbon is at the right end of the section, the processor checks (block 60) the status of flip-flop 51 (which may be set by the counters 59, the photodetector 27 or by manual advance) to decide whether to go to the next section or go back over the preceding one. If either photodetector 27 or counters 59 signal that the ribbon is worn, or manual advance button 50 indicates ribbon advance regardless of ribbon condition, processor 47 reloads the counters 59 and signals the advance into the new section (blocks 61, 62). Otherwise, processor 47 toggles the direction flag, reloads the $\Delta x$ count for the section and begins to go back over the preceding section (blocks 63, 64).

If the minimum length for the ribbon section is chosen ($\Delta L$), the section is only long enough to cover the carrier, the ribbon does not get advanced by any $\Delta x$. Processor 47 implements this by noticing at power-up that $\Delta L_{min}$ was chosen, and computes a zero for the $\Delta x$ count (block 65). This zero value is continually loaded for the $\Delta x$ count and so the ribbon never advances in any direction until the section is worn out.

In summary, the length of each ribbon section ($\Delta L$) is set by the operator during a power-up or RESET operation. While the printer is printing, microprocessor 47 is supervising the uniform wearing of the ribbon section by slowly moving the ribbon back and forth by small increments ($\Delta x$) every few carrier returns. When a ribbon advance is signalled, the processor causes the ribbon to be transported to the next section and repeats the process.

The only other incident which can cause an interrupt to microprocessor 47 is the pushing of the RESET button 67 by the operator. This causes microprocessor 47 to enter the interrupt routine of FIG. 8, loading new parameters ($\Delta L$, counter limits) into storage (blocks 66 and 68). When RESET button 67 was pushed, processor 47 assumes that a new ribbon has been installed.

Therefore, the printer must be off-line when this happens.

A DEFAULT button 69 may be provided which has essentially the same consequences when pushed as RESET button 67, except that the new parameters are read from a default list stored in the non-volatile memory 48.

Figure 10:
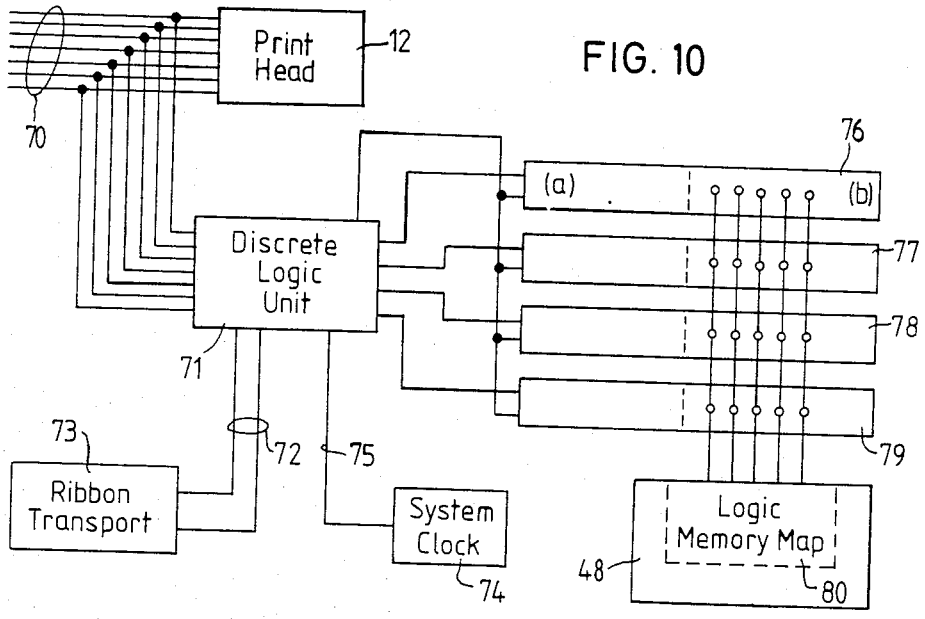
FIG. 10 is a schematical diagram of the counter circuitry of FIG. 7.

FIG. 10 shows the design principle for the counters 59 of FIG. 7. The purpose of the counters is to determine the actual number of impacts performed on each of the color bands of ribbon 18 and to cause ribbon advance to a new ribbon section when the predetermined maximum number of impacts is surpassed.

As mentioned before, print head 12 is assumed to have seven print wires, and accordingly, there will be seven control lines 70 for activating the print wire magnets. These control links 70 are also connected to a discrete logic unit 71 which also receives vertical position control signals over lines 72 from the ribbon transport mechanism 73. A clock signal from system clock 74 via line 75 synchronizes logic unit 71 with the rest of the printer. Depending on which color band 21 through 24 is selected, logic unit 71 enables the appropriate one of counters 76 through 79 which then decrements by the number of times the associated color band is impacted by a print wire. The counters 76 through 79 may be implemented as binary counters, with the proviso that each counter comprises two sections (a) and (b), respectively, counting the least and most significant bits. The input to counters 76 through 79 as well as the most significant bits are continuously mapped in map section 80 of memory 48 so as to permit the system to remember after a power-down which were the latest counts for each of the color bands 21 through 24.

At power-up, either the maximum count predetermined for each color will be set into its associated counter, if the ribbon section is fresh, or the current count reached at the last power-down will be set, if the section was already used for printing. As one of the counters is decremented to zero, processor 47 will notice and cause a fresh ribbon section to be brought in printing position.

The human interface to the printer can vary widely with the kind of printer used. The essential elements of the human interface are shown in FIG. 7 and comprise ribbon advance button 50, RESET button 67, DEFAULT button 69, a visual display 81 for displaying a numerical output from microprocessor 47. This display might e.g. use light emitting diodes, a $\Delta L$ button 82, and a set of microswitches 83, or the like, for entering said predetermined counts for each one of the color bands into microprocessor 47. An alternative to those microswitches 83 would be an appropriate set-up mode preprogrammed so as to write the values direct into random access memory 49.

The mechanisms described above can be implemented on existing and future systems in a variety of different ways, all leading to the performance of the method in accordance with the invention. It will be obvious to those skilled in the art that the ribbon section control described can be implemented as a separate unit interfacing the printer at the power supply, the print control lines and the ribbon transport mechanism. It may also be fully integrated into a host printer, if the printer is run from a microprocessor. In this case, besides the addition of a few components, the program code for the host microprocessor will have to be modified. In printers without a keyboard, the human interface of FIG. 7 may be used. Where there is a keyboard on the printer, the entire human interface could be integrated into the set-up mode of the printer. The availability of a microprocessor offers the additional advantage to monitor and remember the quality status of all sections of the ribbon at the time an advance to a fresh section was made so as to enable a possible return to those sections which still would permit printing in a quality commensurate with the quality then required.

We claim:

1. A method for adaptively using a relatively long length of inked printing ribbon in an impact printer having a print head which moves back and forth across a platen and spooling means for longitudinally spooling the ribbon past the print head intermediate the print head and the platen, such method comprising the steps of:

repeatedly traversing the print head over one longitudinal subsection of the ribbon without any longitudinal advancement of the ribbon;

monitoring the condition of the ink in the subsection being traversed by the print head;

detecting when the condition of the ink in the monitored subsection has reached a predetermined lower tolerance level;

longitudinally advancing the ribbon when the lower tolerance level is detected and thereafter repeatedly traversing a subsequent nonoverlapping longitudinal subsection of the ribbon without any longitudinal advancement of the ribbon; and repeating the monitoring, detecting and advancing steps until substantially the entire length of ribbon is used up.

2. A method for adaptively using a relatively long length of inked plural-color printing ribbon in an impact printer having a print head which moves back and forth across a platen and spooling means for longitudinally spooling the plural-color ribbon past the print head intermediate the print head and the platen, such ribbon having a plurality of parallel color bands which run the length of the ribbon and such method comprising the steps of:

repeatedly traversing the print head over one longitudinal subsection of the ribbon without any longitudinal advancement of the ribbon and using, as needed, the different color bands in such subsection;

individually monitoring the condition of the color in each color band in the subsection being traversed by the print head;

detecting when the condition of the color of any one of the color bands in the monitored subsection has reached a predetermined lower tolerance level;

longitudinally advancing the ribbon when a lower tolerance level is detected and thereafter repeatedly traverseing a subsequent nonoverlapping longitudinal subsection of the plural-color ribbon without any longitudinal advancement of the ribbon; and repeating the monitoring, detecting and advancing steps until substantially the entire length of the plural-color ribbon is used up.

3. A method according to claim 2 wherein:

the condition of each color band is individually monitored by counting the number of printing impacts exercised on such color band in the subsection being traversed by the print head; and the detecting is accomplished by individually comparing the current count for each color band with a predetermined count representative of the exhaustion of that particular color and signalling the reaching of said predetermined count for any one of the color bands for advancing the ribbon and causing the print head to commence traversing a subsequent longitudinal subsection of the ribbon.

4. A method according to claim 2 wherein:

the condition of each color band is individually monitored by shining light through said color bands, passing the resultant light through individual filters associated with each color band and adapted to filter out every color except that of its associated color band, and supplying the light outputs from said filters to individual photosensitive elements for determining the intensity of the light passing through said filters; and the detecting is accomplished by feeding the output signals of said photosensitive elements into associated integrators, and comparing the outputs from said integrators with predetermined thresholds special to each one of the color bands.

5. A mechanism for adaptively using a relatively long length of inked printing ribbon in an impact printer having a print head which moves back and forth across a platen and spooling means for longitudinally spooling the ribbon past the print head intermediate the print head and the platen, such mechanism comprising:

means for repeatedly traversing the print head over one longitudinal subsection of the ribbon without any longitudinal advancement of the ribbon;

means for automatically monitoring the condition of the ink in the subsection being traversed by the print head;

means for automatically detecting when the condition of the ink in the monitored subsection has reached a predetermined lower tolerance level;

means for automatically longitudinally advancing the ribbon when the lower tolerance level is detected and thereafter holding the ribbon without any longitudinal advancement so that the print head repeatedly traverses a subsequent nonoverlapping longitudinal subsection of the ribbon; and means for automatically repeating the monitoring, detecting and advancing actions until substantially the entire length of ribbon is used up.

6. A mechanism for adaptively using a relatively long length of inked plural-color printing ribbon in an impact printer having a print head which moves back and forth across a platen and spooling means for longitudinally spooling the plural-color ribbon past the print head intermediate the print head and the platen, such ribbon having a plurality of parallel color bands which run the length of the ribbon and such mechanism comprising:

means for repeatedly traversing the print head over one longitudinal subsection of the ribbon without any longitudinal advancement of the ribbon and using, as needed, the different color bands in such subsection;

means for automatically and individually monitoring the condition of the color in each color band in the subsection being traversed by the print head;

means for automatically detecting when the condition of the color of any one of the color bands in the monitored subsection has reached a predetermined lower tolerance level;

means for automatically longitudinally advancing the ribbon when a lower tolerance level is detected and thereafter holding the ribbon without any longitudinal advancement so that the print head repeatedly traverses a subsequent nonoverlapping longitudinal subsection of the plural-color ribbon; and means for automatically repeating the monitoring, detecting and advancing actions until substantially the entire length of plural-color ribbon is used up.

7. A method for adaptively using a relatively long length of inked printing ribbon in an impact printer having a print head which moves back and forth across a platen and spooling means for longitudinally spooling the ribbon past the print head intermediate the print head and the platen, said ribbon being composed of a plurality of longitudinally nonoverlapping sections with each of said sections being composed of a plurality of longitudinally overlapping subsections, such method comprising the steps of:

traversing the print head over a first subsection;

feeding the ribbon and traversing the print head over another one of said subsections in the same section as the first subsection;

monitoring the condition of the ink in the section being traversed by the print head for detecting when the condition of the ink in this section has reached a predetermined lower tolerance level;

repeating the traversing, feeding and monitoring steps until the lower tolerance level is detected;

longitudinally advancing the ribbon to a new section when the lower tolerance level is detected in the previous section and thereafter repeatedly traversing the new longitudinal section of the ribbon; and repeating the repeating and advancing steps until substantially the entire length of ribbon is used up.

8. A method for adaptively using a relatively long length of inked plural-color printing ribbon in an impact printer having a print head which moves back and forth across a platen and spooling means for longitudinally spooling the plural-color ribbon past the print head intermediate the print head and the platen, said ribbon having a plurality of parallel color bands which run the length of the ribbon, said ribbon being composed of a plurality of longitudinally nonoverlapping sections with each of said sections being composed of a plurality of longitudinally overlapping subsections, and such method comprising the steps of:

traversing the print head over a first subsection;

feeding the ribbon and traversing the print head over another one of said subsections in the same section as the first subsection;

individually monitoring the condition of the color in each color band in the section being traversed by the print head for detecting when the condition of the color of any one of the color bands in the monitored section has reached a predetermined lower tolerance level;

repeating the traversing, feeding and monitoring steps until the lower tolerance level is detected for any one of the color bands;

longitudinally advancing the ribbon to a new section when a lower tolerance level is detected in the previous section and thereafter repeatedly traversing the new longitudinal section of the plural-color ribbon; and repeating the repeating and advancing steps until substantially the entire length of the plural-color ribbon is used up.

9. A method according to claim 8 wherein:

the condition of each color band is individually monitored by counting the number of printing impacts exercised on such color band in the section being traversed by the print head; and the detecting is accomplished by individually comparing the current count for each color band with a predetermined count representative of the exhaustion of that particular color and signalling the reaching of said predetermined count for any one of the color bands for advancing the ribbon and causing the print head to commence traversing the new longitudinal section of the ribbon.

10. A method according to claim 8 wherein:

the condition of each color band is individually monitored by shining light through said color bands, passing the resultant light through individual filters associated with each color band and adapted to filter out every color except that of its associated color band, and supplying the light outputs from said filters to individual photosensitive elements for determining the intensity of the light passing through said filters; and the detecting is accomplished by feeding the output signals of said photosensitive elements into associated integrators, and comparing the outputs from said integrators with predetermined thresholds special to each one of the color bands.

11. A mechanism for adaptively using a relatively long length of inked printing ribbon in an impact printer having a print head which moves back and forth across a platen and spooling means for longitudinally spooling the ribbon past the print head intermediate the print head and the platen, said ribbon being composed of a plurality of longitudinally nonoverlapping sections with each of said sections being composed of a plurality of longitudinally overlapping subsections, such mechanism comprising:

means for traversing the print head over a first subsection;

means for feeding the ribbon and traversing the print head over another one of said subsections in the same section as the first subsection;

means for automatically monitoring the condition of the ink in the section being traversed by the print head and for automatically detecting when the condition of the ink in the monitored section has reached a predetermined lower tolerance level;

means for automatically repeating the traversing, feeding and monitoring functions until the lower tolerance level is detected;

means for automatically longitudinally advancing the ribbon to a new section when the lower tolerance level is detected in the previous section and thereafter repeatedly traversing the new longitudinal section of the ribbon; and means for automatically repeating the repeating and advancing actions until substantially the entire length of ribbon is used up.

12. A mechanism for adaptively using a relatively long length of inked plural-color printing ribbon in an impact printer having a print head which moves back and forth across a platen and spooling means for longitudinally spooling the plural-color ribbon past the print head intermediate the print head and the platen, said ribbon having a plurality of parallel color bands which run the length of the ribbon, said ribbon being composed of a plurality of longitudinally nonoverlapping sections with each of said sections being composed of a plurality of longitudinally overlapping subsections, and such mechanism comprising:

means for traversing the print head over a first subsection;

means for feeding the ribbon and traversing the print head over another one of said subsections in the same section as the first subsection;

means for automatically and individually monitoring the condition of the color in each color band in the section being traversed by the print head and for automatically detecting when the condition of the color of any one of the color bands in the monitored section has reached a predetermined lower tolerance level;

means for automatically repeating the traversing, feeding and monitoring functions until the lower tolerance level is detected for any one of the color bands;

means for automatically longitudinally advancing the ribbon to a new section when a lower tolerance level is detected in the previous section and thereafter repeatedly traversing the new longitudinal section of the plural-color ribbon; and means for automatically repeating the repeating and advancing actions until substantially the entire length of plural-color ribbon is used up.

* * * * *